US008881658B2

(12) United States Patent
Starbatty

(10) Patent No.: US 8,881,658 B2
(45) Date of Patent: Nov. 11, 2014

(54) DRIVE UNIT FOR RAIL VEHICLES

(75) Inventor: Frank Starbatty, Heidenheim (DE)

(73) Assignee: Voith Patent GmbH, Heidenheim (DE)

( * ) Notice: Subject to any disclaimer, the term of this patent is extended or adjusted under 35 U.S.C. 154(b) by 178 days.

(21) Appl. No.: 13/320,983

(22) PCT Filed: Feb. 25, 2011

(86) PCT No.: PCT/EP2011/000937

§ 371 (c)(1),
(2), (4) Date: Jan. 27, 2012

(87) PCT Pub. No.: WO2011/137943

PCT Pub. Date: Nov. 10, 2011

(65) Prior Publication Data

US 2012/0125224 A1 May 24, 2012

(30) Foreign Application Priority Data

May 4, 2010 (DE) ..... 10 2010 019 392

(51) Int. Cl.
*B61C 9/48* (2006.01)
*B61C 9/50* (2006.01)

(52) U.S. Cl.
CPC ..... *B61C 9/48* (2013.01)
USPC ..... 105/96.1; 105/133; 105/137; 105/140

(58) Field of Classification Search
USPC ..... 105/96.1, 133, 136, 137, 140
See application file for complete search history.

(56) References Cited

U.S. PATENT DOCUMENTS

| | | | | |
|---|---|---|---|---|
| 2,023,856 | A | 12/1935 | Sanders | |
| 3,244,116 | A * | 4/1966 | McGlade | 105/96 |
| 5,791,256 | A | 8/1998 | Johnson | |
| 6,431,929 | B2 * | 8/2002 | Schafer et al. | 440/83 |

FOREIGN PATENT DOCUMENTS

| | | |
|---|---|---|
| DE | 195 30 155 | 2/1997 |
| DE | 102 25 708 | 9/2007 |
| DE | 10 2008 008 027 | 8/2009 |
| EP | 0 792 784 | 9/1997 |
| GB | 628681 | 9/1949 |
| WO | WO 96/25314 | 8/1996 |

* cited by examiner

*Primary Examiner* — Mark Le
(74) *Attorney, Agent, or Firm* — Farjami & Farjami LLP

(57) ABSTRACT

A drive unit for rail vehicles has a shaft including a hearing pin on each end for carrying a drive wheel, a supporting tube enclosing the shaft and journaled thereon, an engine mounted on a supporting tube, wherein the engine rests on a single bracket, the single bracket fastened to the supporting tube, a transmission including a spur wheel and a drive pinion, a housing enclosing a spur gear and the drive pinion, the housing including a single main part, a lid, and an engine bell, the engine bell forming a fixed connection between an engine housing and the main part of the housing, where the supporting tube is molded to the single main part of the housing to form a rigid unit and an engine rotor journaled on a single bearing, wherein the engine rotor is supported at a transmission side on a membrane coupling, the membrane coupling carried by a fully journaled drive pinion.

3 Claims, 2 Drawing Sheets

-Prior Art-

-Prior Art-

DRIVE UNIT FOR RAIL VEHICLES

This is a U.S. national phase application, which is based on, and claims priority from, PCT application Serial No. PCT/EP2011/000937, filed Feb. 25, 2011, which claims priority from foreign application Serial No. 10 2010 019 392.5, filed May 4, 2010, in Germany.

BACKGROUND OF THE INVENTION

The invention concerns a drive unit for electrical rail vehicles. See for instance DE 195 30 155 AI, WO 96/25314 AI. Document DE 102 25 708 B4 describes a transmission housing for receiving a transmission main wheel, with a bonnet, which is fitted with a flange. The transmission housing is arranged as a single-part in the region of a bearing. The bonnet is arranged as a partial hood.

Document DE 10 2008 008 027 describes a drive unit having a transmission which is supported on the travelling motor.

A suitable vibration behaviour of the drive unit can be observed in particular with fast moving vehicles. The masses of unsprung components should be kept as low as possible and more precisely for preserving the drive unit, as well as the roadway. Such is not always the case with the drive units known so far.

The object of the invention is then to design a drive unit of the kind mentioned above in such a way that the mass of the involved components can be kept as minimal as possible and that the driving dynamics are improved with respect to known drive units.

BRIEF SUMMARY OF THE INVENTION

The important characteristics of the invention are as follows:

The housing consists of a single main part and of a lid.

The engine rests on a single console, which is fastened to the supporting tube. The supporting tube is moulded to the main part of the housing, so that both of them form a rigid unit together.

The inventor has recognised a significant shortcoming of conventional drive units: If the housing consists of two components, these must always be set up separately on machine tools for machining purposes, for instance for drilling or milling. The consequence is that manufacturing tolerances add up when paired. Instead of that, the one-piece design of the housing enables its production in a single setup on the machine tool. The manufacturing tolerances, which otherwise add up, are hence reduced significantly.

With drive units known so far the engine attachment is hyperstatic as a result of its design. This causes deviations of the reference position and hence the risk of undesirable stresses and vibrations.

With the two-part construction type of the housing, it admittedly can be contemplated to screw both housing portions together before final machining. This however has the shortcoming that the housing portions are then not freely interchangeable any longer. They should far more be characterised as belonging together.

BRIEF DESCRIPTION OF THE INVENTION

The state of the art as well as the invention will be better understood with reference to the drawing. The following details are shown:

DETAILED DESCRIPTION

Figure 1:
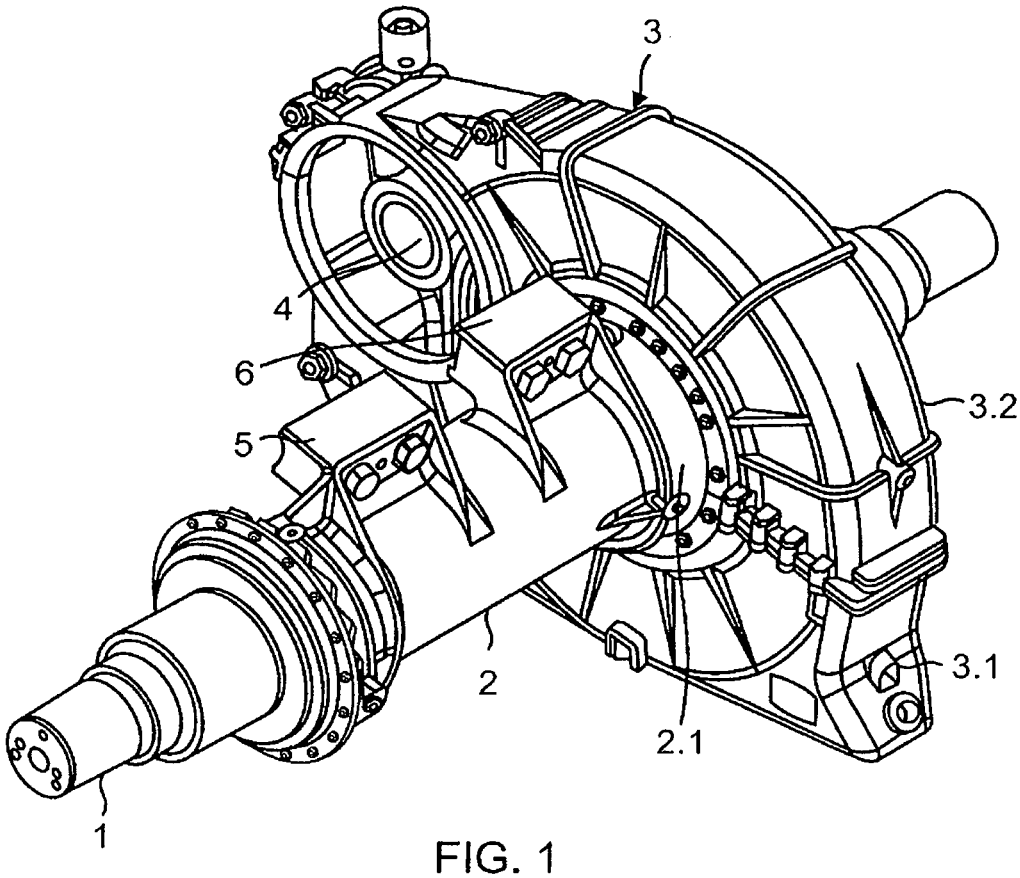
FIG. 1 shows the state of the art.

FIG. 1 represents a drive shaft 1, which carries on both its ends non-illustrated wheels. The drive shaft is mounted in a supporting tube 2, and more precisely by means of nose bearings not shown. A housing 3 is split in two parts—see the housing main section 3.1 and the lid 3.2.

Supporting tube 2 and housing 3 are fixedly connected to one another via a flange 2.1 as well as by means of screws.

The housing encloses a spur gear (not shown) as well as a drive pinion 4.

Two brackets 5, 6 are provided on the supporting tube 2. These carry an engine non-illustrated here. The output shaft of the engine works on the drive pinion 4. This two-part embodiment of housing and supporting tube produces an interface * having the usual manufacturing deficiencies at the connection point of both housing portions 2 and 3. If the latter are added to each not properly this will operation has a negative influence on the exact fit of the connection parts with the engine. It should be noted that the latter is fixedly connected to the supporting tube 2 as well as to the housing 3.

Figure 2:
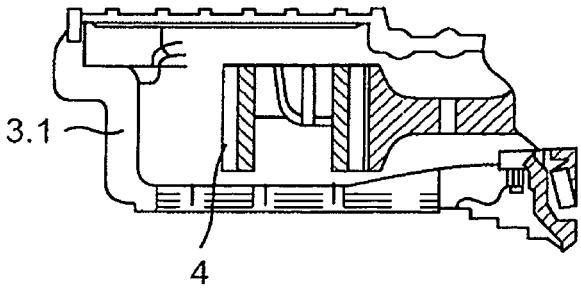
FIG. 2 shows the state of the art.

FIG. 2 enables in turn to recognise the housing, more precisely parts the lower housing portion as well as the drive pinion 4 enclosed thereby.

The embodiment according to the invention differentiates from the form of embodiment according to FIGS. 1 and 2 as follows:

First of all, housing 3 is a single-part. It comprises a main part 3.1, which completely encloses spur gear (not shown) and drive pinion 4, otherwise than with the embodiment according to FIGS. 1 and 2. A lid 3,2 is provided, which covers and hermetically closes the main part 3.1 of the housing 3. Lid 3.2 consists in the present case of a flat plate.

The shaft 1 as well as the supporting tube 2 are clearly visible. The supporting tube 2 includes a single bracket 5. The bracket 5 is mounted on the supporting tube 2. The supporting tube 2 can for instance be produced as a cast part in a single process together with the housing parts 3.1 and 3.2.

The engine is not shown. An engine bell 7 is however recognisable. Said bell is in the shape of a truncated cone in the present case. It comprises a ring 7.1 as well as spokes 7.2. The spokes 7.2 are—seen in direction of the rotational axis of the drive pinion 4—arranged radially. They radially external ends mesh into the ring 7, and their radially internal ends the main part 3.1 of the housing.

The engine is mounted on the console 5 as well as on the ring 7.1 of the engine bell. The blower air of the engine flows through the interspaces between the spokes 7.2 outwardly.

Figure 3:
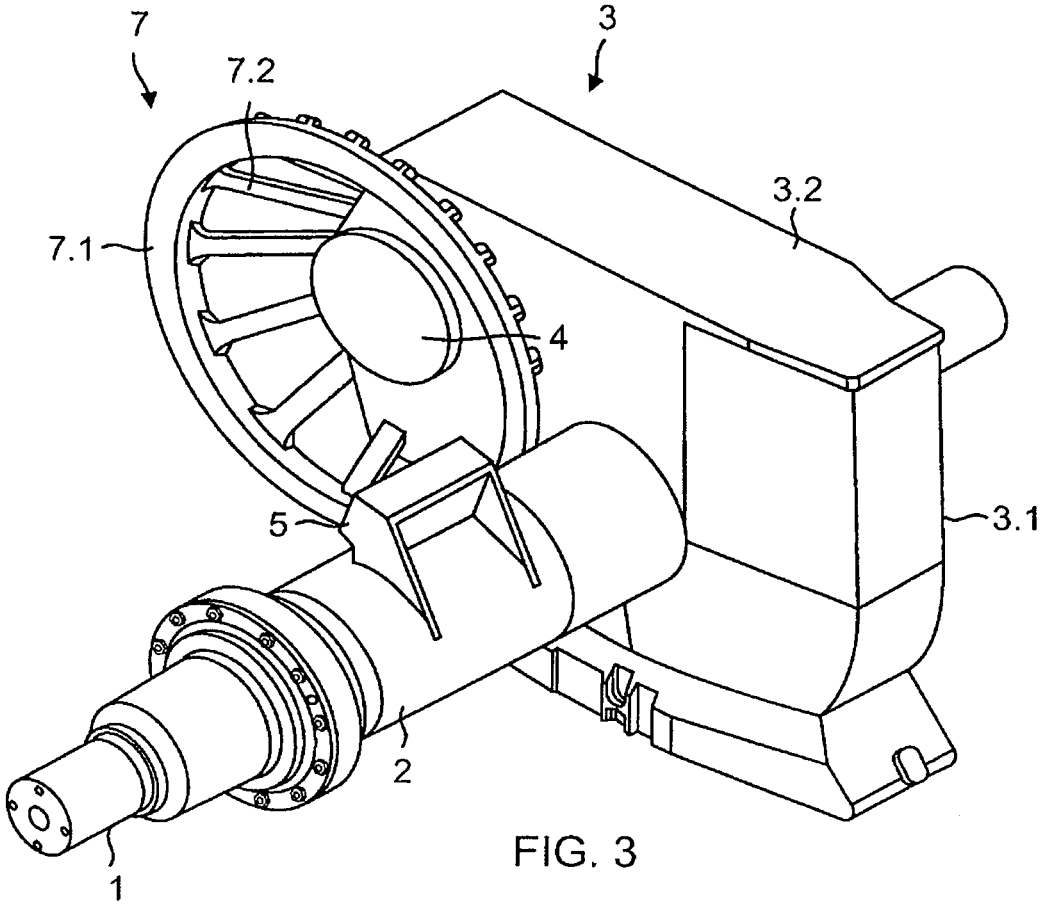
FIG. 3 shows the important parts of a drive unit according to the invention in perspective representation.
Figure 4:
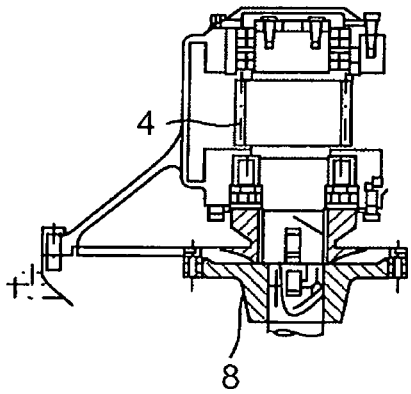
FIG. 4 shows a portion of the housing and of the drive pinion in elevation view on a horizontal section.

A substantial advantage of the form of embodiment according to the invention shown in FIGS. 3 and 4 consists in the one-piece design of the housing 3, more precisely the main part 3.1 of the housing. Significant savings can hence be achieved when machining the housing. The housing parts 3.1 and 3.2 could admittedly also be screwed together before final machining in the case of a two-part embodiment, so that manufacturing tolerances do not add up. Then both parts need however be characterised for further matching to one another. This operation is skipped thanks to the single-part embodiment according to the invention.

Moreover, the main part 3.1 of the housing 3 and the supporting tube are as a single-part since the supporting tube 2 is moulded to the main part of the housing 3.1. The single console 5 as well as the exact positioning of the engine bell 7 ensure exact positioning of the engine as well as fastening thereof with distinct reduction of the negative effects of the static overdetermination.

The one-piece design of the main part 3.1 of the housing 3 enables to dispense with any connection interface and hence improves the operating precision.

The drive pinion 4 is connected to and actuated by the engine via a membrane coupling 8. See FIG. 4. The fully seated drive pinion 4 carries the membrane coupling 8. Due to the high running precision and to the high radial stiffness of the membrane coupling 8, the rotor of the engine is sensed with accuracy and reliably, even without own bearings.

For easier assembly and disassembly of the engine, the membrane coupling 8 can be split and the parts connected to one another with a screw connection The additional advantages are as follows:

Reduction of the machining costs of the housing.

Reduction in the quantity of the various components, which implies smaller costs of warehousing, procurement and so forth.

The technical risk is reduced, since defects which may crop up during sealing and connecting two housing parts have been eliminated.

The invention claimed is:

1. A drive unit for rail vehicles, the drive unit comprising:

a shaft including a bearing pin on each end for carrying a drive wheel;

a supporting tube enclosing the shaft and journaled thereon;

an engine mounted on a supporting tube, wherein the engine rests on a single bracket, the single bracket fastened to the supporting tube;

a transmission including a spur wheel and a drive pinion;

a housing enclosing a spur gear and the drive pinion, the housing including a single main part, a lid, and an engine bell, the engine bell forming a fixed connection between an engine housing and the main part of the housing, wherein the supporting tube is molded to the single main part of the housing to form a rigid unit; and a rotor of the engine, wherein the rotor is only journaled on a single bearing, and wherein the rotor is supported at a transmission side on a membrane coupling, the membrane coupling carried by a fully journaled drive pillion.

2. The drive unit according to claim 1, wherein the engine bell contains a ring which is concentric to a rotational axis of the engine, and a plurality of spokes the plurality of spokes connected to the single main part of the housing by radially internal ends of the plurality of spokes.

3. The drive unit according to claim 1, wherein the drive pinion is connected to and actuated by the engine via a membrane coupling.

* * * * *

UNITED STATES PATENT AND TRADEMARK OFFICE

CERTIFICATE OF CORRECTION

PATENT NO. : 8,881,658 B2
APPLICATION NO. : 13/320983
DATED : November 11, 2014
INVENTOR(S) : Frank Starbatty It is certified that error appears in the above-identified patent and that said Letters Patent is hereby corrected as shown below:

In the claims,

Column 4, line 19, "pillion" should be changed to --pinion--.

Signed and Sealed this
Thirty-first Day of March, 2015

Michelle K. Lee

Michelle K. Lee
*Director of the United States Patent and Trademark Office*